US007600493B2

(12) United States Patent
Geiser

(10) Patent No.: US 7,600,493 B2
(45) **Date of Patent: *Oct. 13, 2009**

(54) SPLINE DRIVE AND CAM SHAFTS FOR BARREL ENGINES

(75) Inventor: Randall R. Geiser, Dexter, MI (US)

(73) Assignee: Thomas Engine Company, LLC, Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/672,662

(22) Filed: Feb. 8, 2007

(65) Prior Publication Data

US 2007/0186881 A1 Aug. 16, 2007

Related U.S. Application Data

(60) Provisional application No. 60/773,263, filed on Feb. 14, 2006.

(51) Int. Cl.
*F02B 75/26* (2006.01)

(52) U.S. Cl. ..... 123/56.3

(58) Field of Classification Search ..... 123/56.2, 123/56.3, 56.1, 43 AA, 56.6, 56.9
See application file for complete search history.

(56) References Cited

U.S. PATENT DOCUMENTS

| | | | | |
|---|---|---|---|---|
| 2,243,817 | A | 5/1941 | Herrmann | |
| 2,983,264 | A | 5/1961 | Herrmann | |
| 3,207,082 | A * | 9/1965 | Pitt et al. | 91/507 |
| 3,241,495 | A * | 3/1966 | Diedrich et al. | 91/507 |
| 3,319,874 | A * | 5/1967 | Welsh | 417/271 |
| 6,192,853 | B1 * | 2/2001 | Natsume | 123/196 W |
| 7,409,932 | B2 * | 8/2008 | Gaiser | 123/56.2 |
| 2006/0037567 | A1 * | 2/2006 | Thomas | 123/56.7 |
| 2007/0186880 | A1 * | 8/2007 | Gaiser | 123/55.5 |

* cited by examiner

*Primary Examiner*—Hai H Huynh
(74) *Attorney, Agent, or Firm*—Gifford, Krass, Sprinkle, Anderson & Citkowski, P.C.

(57) ABSTRACT

A shaft assembly for a barrel internal combustion engine having valves controlling the intake and exhaust of gases during operation of the engine. The shaft assembly includes a drive shaft and a cam shaft. The drive shaft extends longitudinally between opposite first and second ends along a rotational axis. The cam shaft has cam lobes for actuating the valves of the engine. The cam shaft is coupled in a spline arrangement with an end of the drive shaft for rotation therewith about the rotational axis. The cam shaft is substantially coaxial with the drive shaft.

16 Claims, 2 Drawing Sheets

SPLINE DRIVE AND CAM SHAFTS FOR BARREL ENGINES

REFERENCE TO RELATED APPLICATION

This application claims priority to U.S. Provisional Patent Application Ser. No. 60/773,263, filed Feb. 14, 2006, the entire content of which is incorporated herein by reference.

FIELD OF THE INVENTION

The invention relates to barrel-type internal combustion engines. More particularly, the invention relates to the assembly of drive shafts and cam shafts for use in barrel engines.

BACKGROUND OF THE INVENTION

Internal combustion engines are widely used for driving a variety of vehicles. Internal combustion engines come in a variety of configurations, which are typically aptly named for the particular orientation or arrangement of the reciprocating pistons and cylinders in the engines. One example of an internal combustion engine is a "V" type engine, in which the "V" refers to the arrangement of the cylinders in rows that are angled relative to each other to form a V shape. Another type of internal combustion engine that is most relevant to the invention is a barrel-type engine.

The barrel engine includes a plurality of cylinders and pistons arranged in the form of a "barrel" in which their axes are parallel to each other and typically arranged along a circle concentric with the drive shaft. Power is transmitted from the reciprocating pistons to a cam plate via a roller or bearing interface. The cam plate's nominal plane is perpendicular to the piston axes and attached to the drive shaft for movement therewith. The cam plate also has a generally sinusoidal shape, so that the axial reciprocal movement of the pistons causes rotational movement of the cam plate and drive shaft.

The intake and exhaust valves of the barrel engine may be actuated by cams that are driven by the drive shaft. In conventional designs, the cams are integrally formed with the drive shaft in a casting and/or milling processes, which results in relatively high manufacturing costs. It is, therefore, desirable to provide an improved drive shaft design that is less expensive to produce than conventional drive shaft designs, and/or provides other benefits.

SUMMARY OF THE INVENTION

According to one aspect of the invention, a shaft assembly is provided for a barrel internal combustion engine having valves controlling the intake and exhaust of gases during operation of the engine. The shaft assembly includes a drive shaft and a cam shaft. The drive shaft extends longitudinally between opposite first and second ends along a rotational axis. The cam shaft has cam lobes for actuating the valves of the engine. The cam shaft is coupled in a spline arrangement with an end of the drive shaft for rotation therewith about the rotational axis. The cam shaft is substantially coaxial with the drive shaft.

According to another aspect of the invention, a barrel internal combustion engine includes an engine block, a plurality of pistons, a drive shaft, a cam plate and a cam shaft. The engine block has a plurality of cylinders. The plurality of pistons are slidably coupled to the plurality of cylinders for reciprocal movement along axes generally parallel with a central axis. The drive shaft extends longitudinally between opposite first and second ends for rotation about the central axis. The cam plate is coupled to the drive shaft for rotation therewith. The cam plate is operatively coupled to the pistons to cause rotation of the drive shaft about the central axis in response to the reciprocal movement of the pistons. The cam shaft has cam lobes for actuating intake and exhaust valves of the engine. The cam shaft is coupled in a spline arrangement with one of the first and second ends of the drive shaft for rotation therewith about the rotational axis. The spline arrangement allows a single rotational orientation of the cam shaft relative to the drive shaft.

BRIEF DESCRIPTION OF THE DRAWINGS

Advantages of the present invention will be readily appreciated as the same becomes better understood by reference to the following detailed description when considered in connection with the accompanying drawings, wherein.

DETAILED DESCRIPTION OF THE INVENTION

Figure 1:
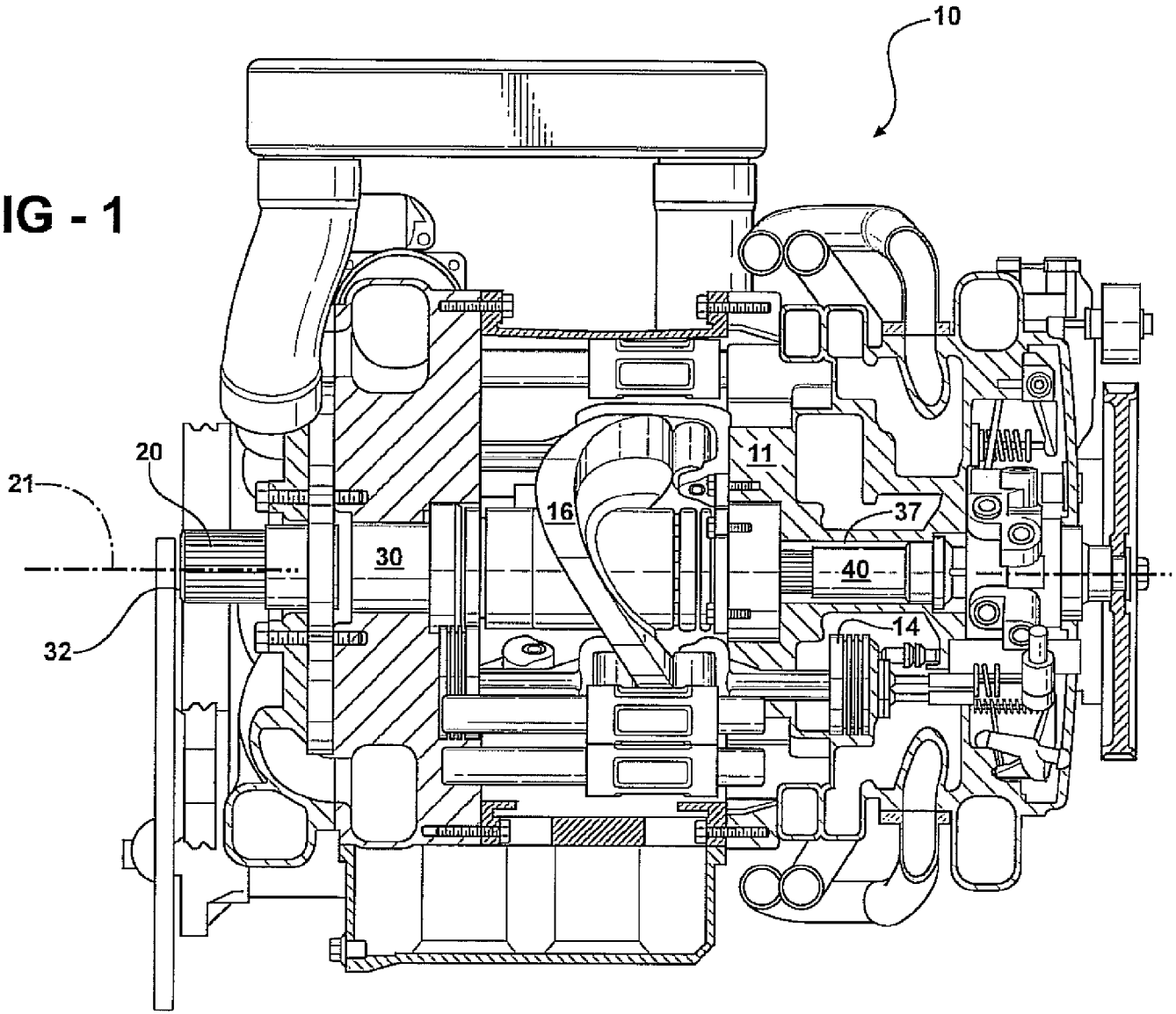
FIG. 1 is a cross-sectional side view of a barrel engine according to one aspect of the invention.

Referring to FIG. 1, a barrel-type internal combustion engine according to the invention is generally indicated at 10. The engine 10 includes an engine block 11 having a plurality of cylinders and pistons 14 arranged concentrically about a central drive shaft assembly 20. The pistons 14 are slidably engaged within the respective cylinders for reciprocal axial movement therein. Power is transmitted from the reciprocating pistons 14 to a cam plate 16 via a roller or bearing interface. The cam plate 16 is coupled to the shaft assembly 20 for rotation therewith about a rotational axis 21. The cam plate 16 has a generally sinusoidal shape, such that the reciprocal axial movement of the pistons 14 causes corresponding rotational movement of the cam plate 16 and shaft assembly 20.

The shaft assembly 20 includes a drive shaft 30 and a cam shaft 40. The drive 30 and cam 40 shafts are coupled in a spline arrangement, which couples the shafts 30, 40 in the rotational direction and allows assembly or disassembly in the axial direction. Having separable drive 30 and cam 40 shafts provides reduced overall manufacturing complexity associated with forming a single conventional drive shaft having integrated valve cams. Having separable drive 30 and cam 40 shafts also provides enhanced flexibility in the assembly of the barrel engine 10, such as by allowing post assembly of the cam shaft 40 to the drive shaft 30 after the engine block 10 has been sealed. It should be appreciated that splines or spline arrangements as discussed herein refers to radially extending teeth, which in one embodiment of the invention are involute. The drive 30 and cam 40 shafts of the shaft assembly 20 are now described in greater detail below.

Figure 2:
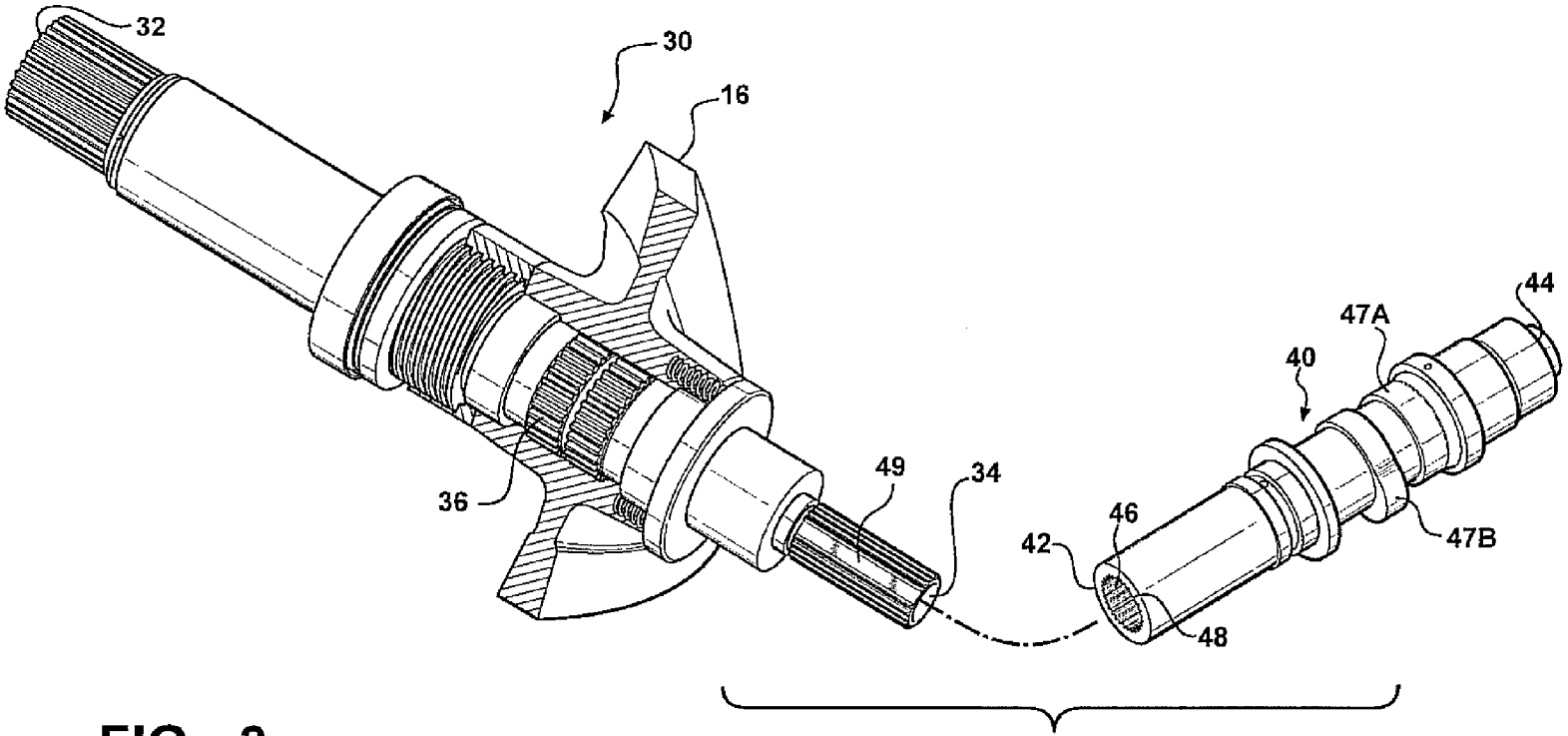
FIG. 2 is a perspective view of a drive shaft in the barrel engine of FIG. 1.

As shown in FIG. 2, the drive shaft 30 extends axially between opposite first 32 and second 34 ends. The first end 32 includes outwardly extending spline teeth for coupling the drive shaft 30 to a primary driven device, such as a transmission. A middle portion 36 of the drive shaft 30 includes outwardly extending spline teeth for engaging the cam plate 16. The second end 34 of the drive shaft 30 is defined by a reduced diameter portion having outwardly extending spline teeth. 31. A cylindrical bearing surface 33 is formed adjacent the outwardly extending spline teeth 31. The bearing surface 33 supports the drive shaft 30 within a central bore 37 of the engine block 11.

Figure 3:
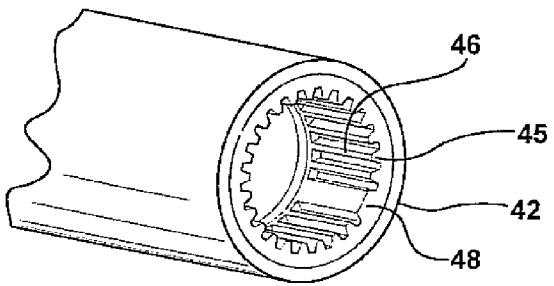
FIG. 3 is a perspective view of an end of a cam shaft in the barrel engine of FIG. 1.

As shown in FIGS. 2 and 3, the cam shaft 40 extends axially between opposite receiving 42 and cam 44 ends. The receiving end 42 of the cam shaft 40 includes a center bore 46 for receiving the second end 34 of the drive shaft 30 therein. The walls defining the center bore 46 include radially inwardly extending spline teeth 45 for engaging the second end 34 of the drive shaft 30. At least one of the teeth 48 from the center bore 46 may be oversized relative to the other teeth to engage a corresponding oversized groove 49 on the second end 34 of the drive shaft 30 By this arrangement, the cam shaft 40 and drive shaft 30 are keyed to allow assembly in a single orientation in the rotational direction relative to each other. Alternatively, the groove may be in the cam shaft while the oversized tooth may be on the drive shaft. Also, other arrangements than illustrated may be used. For example, larger or smaller spline teeth may be used.

The cam shaft 40 includes intake 47A and exhaust 47B cam lobes for actuating intake and exhaust valves of the engine 10. The lobes 47A, 47B extend radially outwardly from the cam shaft 40 along planes substantially normal to the rotational axis of the drive 30 and cam 40 shafts. As shown, the intake cam lobe 47A is located closer to the cam end 44 of the cam shaft 40 than the exhaust cam lobe 47B. Alternatively, the exhaust cam lobe 47B may be located closer to the cam end 44. The cam lobes 47A, 47B are shown as unitarily formed with the cam shaft 40. It should, however, be readily appreciated that the lobes 47A, 47B may be manufactured separately and subsequently assembled to the cam shaft 40. This would allow the use of different materials for the lobes 47A, 47B and cam shaft 40.

The invention has been described in an illustrative manner. It is, therefore, to be understood that the terminology used is intended to be in the nature of words of description rather than of limitation. Many modifications and variations of the invention are possible in light of the above teachings. For example, the male and female configuration of the drive shaft and cam shaft as specifically shown in the figures may be reversed. Thus, within the scope of the appended claims, the invention may be practiced other than as specifically described.

I claim:

1. A barrel internal combustion engine comprising:

an engine block having a plurality of cylinders;

a plurality of pistons slidably coupled to the plurality of cylinders for reciprocal movement along axes generally parallel with a central axis;

a drive shaft extending longitudinally between opposite first and second ends for rotation about the central axis;

a cam plate coupled to the drive shaft for rotation therewith, the cam plate being operatively coupled to the pistons to cause rotation of the drive shaft about the central axis in response to the reciprocal movement of the pistons; and a cam shaft having cam lobes for actuating intake and exhaust valves of the engine, the cam shaft being coupled in a spine arrangement with one of the first and second ends of the drive shaft for rotation therewith about the rotational axis, the spline arrangement allowing a single rotational orientation of the cam shaft relative to the drive shaft.

2. A barrel engine as set forth in claim 1, wherein the end of the drive shaft includes a plurality of radially outwardly extending spline teeth.

3. A barrel engine as set forth in claim 2, wherein the cam shaft includes an end having a generally cylindrical wall defining a central bore for receiving the end of the drive shaft therein.

4. A barrel engine as set forth in claim 3, wherein the cam shaft includes a plurality of radially inwardly extending spline teeth for engaging the outwardly extending spline teeth of the drive shaft.

5. A barrel engine as set forth in claim 4, wherein at least one of the spline teeth of one of the drive and cam shafts is oversized relative to the other spline teeth.

6. A barrel engine as set forth in claim 1, wherein the at least one of the spline teeth of one of the drive and cam shafts extends through a corresponding slot formed in the other of the drive and cam shafts to allow one rotational orientation during insertion of the end of the drive shaft into the center bore of the cam shaft.

7. A barrel engine as set forth in claim 1, wherein the cam shaft includes lobes for actuating the valves of the engine, the lobes extending radially outwardly from the cam shaft along a plane substantially normal to the rotational axis of the drive shaft.

8. A barrel engine as set forth in claim 7, wherein the lobes are formed separately and assembled to the cam shaft.

9. A shaft assembly for a barrel internal combustion engine having valves controlling the intake and exhaust of gases during operation of the engine, said shaft assembly comprising:

a drive shaft extending longitudinally between opposite first and second ends along a rotational axis; and a cam shaft having cam lobes for actuating the valves of the engine, the cam shaft being coupled in a spline arrangement with an end of the drive shaft for rotation therewith about the rotational axis, the cam shaft being substantially coaxial with the drive shaft.

10. A shaft assembly as set forth in claim 9, wherein the end of the drive shaft includes a plurality of radially outwardly extending spline teeth.

11. A shaft assembly as set forth in claim 10, wherein the cam shaft includes an end having a generally cylindrical wall defining a central bore for receiving the end of the drive shaft therein.

12. A shaft assembly as set forth in claim 11, wherein the cam shaft includes a plurality of radially inwardly extending spline teeth for engaging the outwardly extending spline teeth of the drive shaft.

13. A shaft assembly as set forth in claim 12, wherein at least one of the spline teeth of one of the drive and cam shafts is oversized relative to the other spline teeth.

14. A shaft assembly as set forth in claim 12, wherein the at least one of the spline teeth of one of the drive and cam shafts extends through a corresponding slot formed in the other of the drive and cam shafts to allow one rotational orientation during insertion of the end of the drive shaft into the center bore of the cam shaft.

15. A shaft assembly as set forth in claim 9, wherein the cam shaft includes lobes for actuating the valves of the engine, the lobes extending radially outwardly from the cam shaft along a plane substantially normal to the rotational axis of the drive shaft.

16. A shaft assembly as set forth in claim 15, wherein the lobes are formed separately and assembled to the cam shaft.

* * * * *